US008944358B2

(12) United States Patent
Copp et al.

(10) Patent No.: US 8,944,358 B2
(45) Date of Patent: Feb. 3, 2015

(54) PACKAGE AND LOCKING RING FOR DISPENSING WOUND MATERIAL FROM A CONTAINER

(75) Inventors: Timothy Copp, Danbury, CT (US); Brian Moore, Newburgh, NY (US); G. Taylor Richey, Hopewell Junction, NY (US)

(73) Assignee: Reelex Packaging Solutions, Inc., Patterson, NY (US)

( * ) Notice: Subject to any disclaimer, the term of this patent is extended or adjusted under 35 U.S.C. 154(b) by 90 days.

(21) Appl. No.: 13/374,125

(22) Filed: Dec. 13, 2011

(65) Prior Publication Data

US 2013/0146696 A1 Jun. 13, 2013

(51) Int. Cl.
*B65H 51/015* (2006.01)

(52) U.S. Cl.
USPC ..... 242/171; 242/615.3; 242/129; 206/409

(58) Field of Classification Search
USPC ..... 242/588, 588.3, 579, 580, 580.1, 615.3, 242/128, 129, 157 R, 566, 171, 170; 206/409, 303
See application file for complete search history.

(56) References Cited

U.S. PATENT DOCUMENTS

| | | | |
|---|---|---|---|
| 1,463,181 | A | 7/1923 | Vorderwinkler |
| 1,529,816 | A | 3/1925 | Stenglein |
| 2,388,557 | A | 11/1945 | Little et al. |
| 2,459,747 | A | 1/1949 | Kolbe |
| 2,634,918 | A | 4/1953 | Taylor et al. |
| 2,634,922 | A | 4/1953 | Taylor |
| 2,650,036 | A | 8/1953 | Berkepeis |
| 2,738,145 | A | 3/1956 | Taylor |
| 2,767,938 | A | 10/1956 | Taylor |
| 2,929,569 | A | 3/1960 | Detrick et al. |
| 2,943,732 | A | 7/1960 | Kovaleski et al. |
| 2,971,709 | A | 2/1961 | Ellis |
| 3,061,238 | A | 10/1962 | Taylor |
| 3,150,769 | A | 9/1964 | Cohn |
| 3,178,130 | A | 4/1965 | Taylor |
| 3,589,096 | A | 6/1971 | Podvin |

(Continued)

FOREIGN PATENT DOCUMENTS

| | | |
|---|---|---|
| DE | 532861 | 9/1931 |

OTHER PUBLICATIONS

U.S. Appl. No. 13/506,545; Timothy M. Copp et al, filed Apr. 27, 2012; "Proflex" Shrink Bag with Handle & Handle Isolation Apparatus.

(Continued)

*Primary Examiner* — Sang Kim
*Assistant Examiner* — Nathaniel Adams
(74) *Attorney, Agent, or Firm* — Gordon & Jacobson, PC

(57) ABSTRACT

Package and locking ring structure for removal of wound filamentary material from a container including a locking ring attached to a hole in a wall of the container for removal of the wound filamentary material; the locking ring forming a loop of the end portion of the wound filamentary material; the wound filamentary material is withdrawn from the container through the hole by pulling the loop; the locking ring including a pull-off cover plate covering access to the end portion of the wound filamentary material and including a hole for enabling passage of the end portion of the wound filamentary material, and further including means for receiving and retaining the end portion of the wound filamentary material in the form of a loop against the pull-off cover plate.

11 Claims, 3 Drawing Sheets

(56) References Cited

U.S. PATENT DOCUMENTS

| | | | | |
|---|---|---|---|---|
| 3,643,987 | A | 2/1972 | DuPont | |
| 3,655,140 | A | 4/1972 | Gordon et al. | |
| 3,666,200 | A | 5/1972 | Newman et al. | |
| 3,677,490 | A | 7/1972 | Gordon et al. | |
| 3,677,491 | A | 7/1972 | Gerwig | |
| 3,747,861 | A | 7/1973 | Wagner et al. | |
| 3,748,817 | A | 7/1973 | Newman | |
| 3,812,640 | A | 5/1974 | Knott | |
| 3,877,653 | A | 4/1975 | Foltyn et al. | |
| 3,923,270 | A | 12/1975 | Newman et al. | |
| 3,980,244 | A | 9/1976 | Pietroni | |
| 3,982,712 | A | 9/1976 | Bassett | |
| 3,985,315 | A | 10/1976 | Newman | |
| 4,009,845 | A * | 3/1977 | Santucci et al. | 242/129.7 |
| 4,019,636 | A | 4/1977 | Wise | |
| 4,022,399 | A * | 5/1977 | Zajac | 242/163 |
| 4,057,203 | A | 11/1977 | Newman et al. | |
| 4,057,204 | A | 11/1977 | Zajac | |
| 4,085,902 | A | 4/1978 | Wagner | |
| 4,098,467 | A | 7/1978 | Engmann et al. | |
| 4,160,533 | A | 7/1979 | Kotzur et al. | |
| 4,274,607 | A | 6/1981 | Priest | |
| 4,283,020 | A | 8/1981 | Bauer et al. | |
| 4,285,157 | A | 8/1981 | Lambert | |
| 4,313,579 | A | 2/1982 | Zuber et al. | |
| D267,394 | S | 12/1982 | Liptak et al. | |
| 4,367,853 | A | 1/1983 | Kotzur | |
| 4,373,687 | A | 2/1983 | Zicko | |
| 4,406,419 | A | 9/1983 | Kotzur | |
| 4,477,033 | A | 10/1984 | Kotzur et al. | |
| 4,523,723 | A | 6/1985 | Kotzur | |
| D285,176 | S | 8/1986 | Kodousek et al. | |
| 4,637,564 | A | 1/1987 | Hallenbeck et al. | |
| 4,792,100 | A | 12/1988 | Pepe | |
| 4,817,796 | A | 4/1989 | Camillo et al. | |
| 4,884,764 | A | 12/1989 | Hill | |
| 5,042,739 | A | 8/1991 | Zajac | |
| 5,053,795 | A | 10/1991 | Wyman | |
| 5,115,995 | A * | 5/1992 | Hunt | 242/157 R |
| 5,121,584 | A | 6/1992 | Suter | |
| 5,150,789 | A | 9/1992 | Bass | |
| 5,150,852 | A | 9/1992 | Hunt et al. | |
| 5,203,139 | A | 4/1993 | Salsburg et al. | |
| D341,777 | S | 11/1993 | Sheu | |
| D348,392 | S | 7/1994 | Tannen | |
| 5,368,245 | A | 11/1994 | Fore | |
| 5,470,026 | A | 11/1995 | Kotzur | |
| 5,499,775 | A | 3/1996 | Vander Groef | |
| 5,520,347 | A | 5/1996 | Bass et al. | |
| 5,529,186 | A | 6/1996 | Bass | |
| 5,593,035 | A | 1/1997 | Taylor et al. | |
| 5,624,528 | A | 4/1997 | Abrams et al. | |
| 5,678,778 | A | 10/1997 | Kotzur et al. | |
| 5,714,936 | A | 2/1998 | Regelsberger | |
| D396,632 | S | 8/1998 | Lee | |
| 5,803,394 | A | 9/1998 | Kotzur et al. | |
| 5,810,272 | A | 9/1998 | Wallace et al. | |
| D400,096 | S | 10/1998 | Lee | |
| D406,753 | S | 3/1999 | Lee | |
| 5,941,050 | A | 8/1999 | Georgetti et al. | |
| 5,979,811 | A * | 11/1999 | Bass et al. | 242/157 R |
| 5,979,812 | A | 11/1999 | Kotzur et al. | |
| 6,003,667 | A | 12/1999 | Barnett et al. | |
| 6,086,012 | A | 7/2000 | Kotzur et al. | |
| 6,098,378 | A | 8/2000 | Wyatt | |
| 6,109,554 | A | 8/2000 | Kotzur et al. | |
| 6,145,722 | A | 11/2000 | Behrens et al. | |
| 6,276,623 | B1 | 8/2001 | Williams | |
| 6,328,238 | B1 * | 12/2001 | Chism | 242/171 |
| 6,341,741 | B1 | 1/2002 | Kotzur et al. | |
| 6,491,163 | B1 | 12/2002 | Grcic et al. | |
| 6,702,213 | B2 | 3/2004 | Kotzur et al. | |
| 6,766,627 | B2 | 7/2004 | Kotzur et al. | |
| 7,007,799 | B2 * | 3/2006 | Cote | 206/409 |
| 7,100,346 | B2 | 9/2006 | Kotzur et al. | |
| 7,156,334 | B1 * | 1/2007 | Fore et al. | 242/171 |
| D541,145 | S | 4/2007 | Copp | |
| 7,249,726 | B2 | 7/2007 | Kotzur | |
| 7,469,520 | B2 | 12/2008 | Lancaster, III et al. | |
| 8,191,337 | B2 | 6/2012 | Moore | |
| 2002/0174626 | A1 | 11/2002 | Lancaster, III et al. | |
| 2007/0272346 | A1 | 11/2007 | Shpik et al. | |
| 2008/0277523 | A1 | 11/2008 | Delmore | |

OTHER PUBLICATIONS

U.S. Appl. No. 13/506,574; Timothy M. Copp et al, filed Apr. 30, 2012; Apparatus for Dividing Heat-Shrinkable Plastic Film into Different Temperature Regions.

* cited by examiner

PACKAGE AND LOCKING RING FOR DISPENSING WOUND MATERIAL FROM A CONTAINER

BACKGROUND OF THE INVENTION

Field of the Invention

This invention relates to plastic locking ring structure for securing a hollow tube to a container retaining a coil of filamentary material wound in a figure-8 configuration and where the filamentary material is dispensed from the inside of the coil through the hollow payout tube. The locking ring structure, in combination with the hollow payout tube and package containing the wound filamentary material, is to be known in the trade as "EcoCore", and the filamentary material wound in a figure-8 configuration is known as a "REELEX-type" coil, (REELEX being the subject of Trademark Registrations #1259164 and #1100554 of REELEX Packaging Solutions, Inc., 39 Jon Barrett Road, Patterson, N.Y. 12563).

A REELEX® packaging system is described and claimed in the following U.S. patents owned by REELEX Packaging Solutions, Inc., (1) U.S. Pat. No. 5678778, issued Oct. 21, 1997 and entitled: "High Speed, Dual Head, On-Line Winding Apparatus"; U.S. Pat. No. 5803394, issued Sep. 08, 1998 and entitled "High Speed, Dual Head, On-Line Winding Apparatus"; and U.S. Pat. No. 7100346, issued Sep. 05, 2006 and entitled: "Machine for Boxing Wound Coils of Filamentary Material". The REELEX I packages feature coils with relatively small woven payout holes with a diameter of approximately one inch. REELEX I coils utilize payout tubes of one inch diameter or less and are placed into containers that are slightly narrower than REELEX II packages. REELEX I packages are commonly used for packaging smooth, highly flexible products such as security and alarm cables, hookup wire, THHN, speaker wire and more. REELEX II packages incorporate both the payout tube design and the coil itself REELEX II coils are made by weaving a much larger payout hole into the coil and thus require a larger diameter payout tube of approximately 2 or 3 inches in diameter.

SUMMARY OF THE INVENTION

The inventive packaging system is a next generation REELEX® packaging system and can serve as a substitute for both the existing REELEX I (small tube) packages as well as REELEX II (big-tube) packages. The inventive packaging system offers equal or better product performance than existing REELEX II packages, but because the payout tube profile is straight and not tapered, packages can be 1.25 inches narrower without jeopardizing payout performance. The inventive packaging system uses an ideal 2.00 inch payout tube diameter for maximum payout performance—allowing REELEX I packages to upgrade to REELEX II package performance without a significant increase in package size.

Similar to a "freshness seal" in the food industry, the locking ring of the inventive package incorporates a unique pull-off cover plate which prevents access to the coil prior to use, prevents tampering and theft, and ensures that the coil is easily accessible. This unique feature uses the coil (or other filamentary product) itself to create a loop for the end-user to grasp and pull on, forcing the cover plate to detach and revealing the rest of the product inside the container. When the looped coil is pulled, the detachable cover plate and beginning end of the coil comes with it, indicating that the package has been opened.

The inventive packaging system combines a recycled paper payout tube with a plastic ring made from recycled materials, and uses 80% less plastic than an equivalent REELEX II payout tube. The carton and payout tube itself can be manufactured from post-consumer recycled paper fibers and combine to create a package that is up to 1.25 inches narrower than comparable REELEX II packages. These features result in a REELEX® package that uses less material, produces less waste and is more efficient to ship.

The locking collar of the invention comprises a circular flange attached to the top of a cup, the outside of which has teeth protruding from the outside of the cup in a direction parallel to the circular flange. The cup portion of the locking collar is sized so that it may be inserted through a hole in the container from the outside and inserted into an open end of the hollow tube which has been inserted into the payout hole of the coil wound in a figure-eight configuration within the container. The combination of a compression fit and anti-reversing teeth on the outside of the locking collar securely fastens the hollow payout tube to the container. Inside the cup portion of the locking collar is a circular plate with a breakaway structure, which on a one half and away distance from the center of the circular plate, has a U-shaped cutout, the purpose of which is to create a trap door in which one end of the coil of wound filamentary material may be inserted from one direction, but captured in the trap door if pulled from the opposite direction. Opposite the U-shaped cutout on the breakaway structure is a hole cutout through which the beginning end of the coil, before being inserted through the trap door, can be pushed through and then bent back on itself and inserted into the trap door feature of the invention. This action creats a loop in the end of the coil whose ends are captured by the breakaway structure. This positioning of the filamentary material effectively creates a "pull handle" providing the means with which a person, such as a cable installer, may pull on the loop and break away the circular plate, allowing the coil material to flow freely from the inside of the figure-eight coil wound in the container.

BRIEF DESCRIPTION OF THE DRAWINGS

FIG. 3 illustrates the creation of a loop with the inside end of the coiled material. The inside end (not shown, see FIGS. 7 & 8) of the coiled material is inserted back into a "trap door" in the plastic locking ring. This loop makes the coiled material easily available to the end user. When the loop is pulled, the cover panel breaks away and may be disposed of.

FIG. 5 also shows the teeth (only two of four are shown) on the periphery of the cup by which the plastic ring is attached to the hole in the container (FIG. 2);

DETAILED DESCRIPTION OF THE INVENTION

Figure 1:
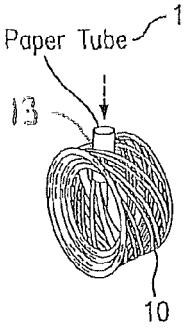
FIG. 1 illustrates a coil of filamentary material wound in a figure-eight configuration with a payout hole in the coil extending from the inside of the coil to the outside of the coil, which is known in the trade as a REELEX$^R$ coil (as explained above), and a regular spiral-wound paper payout tube of approximately ⅛ inch thickness extending into the payout hole through which the end of the coil is inserted so that the filamentary material is withdrawn through the paper payout tube from the inside of the coil to reduce or eliminate tangles and twists in the withdrawn coil of filamentary material.

FIG. 1 illustrates a coil 10 of filamentary material wound in a figure-eight configuration with a payout hole 13 in the coil 10 extending from the inside of the coil 10 to the outside of the coil 10, which is known in the trade as a REELEX$^R$ coil (as explained above), and a regular spiral-wound paper payout tube 12 of approximately ⅛ inch thickness extending into the payout hole 13 and through which the end of the coil is inserted so that the filamentary material is withdrawn through the paper payout tube 12 from the inside of the coil 10 to reduce or eliminate tangles in the withdrawn coil 10 of filamentary material.

Figure 2:
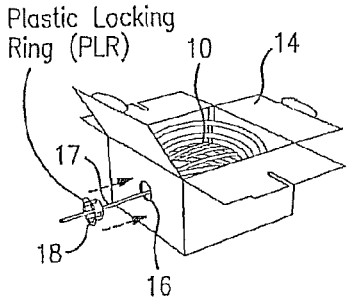
FIG. 2 illustrates a container containing the coil of filamentary material and paper payout tube as shown in FIG. 1 with the inside end of the coil threaded through the paper payout tube, a hole in the container and the plastic locking ring . The plastic locking ring is then pushed firmly through a hole cutout in the container into the paper payout tube, thereby securely locking the paper payout tube, the end of the coil, and plastic ring to the container.

FIG. 2 illustrates a container 14 containing the coil 10 of filamentary material and paper payout tube 12 as shown in FIG. 1 with the inside end 17 of the coil 10 threaded through the paper payout tube 12, a hole 16 in the container 14 and the plastic locking ring 18. The plastic locking ring 18 is then pushed firmly into the paper payout tube 12 and the container 14, thereby securely locking the paper payout tube 12, end 17 of the coil 10 and plastic ring to the container 14.

Figure 3:
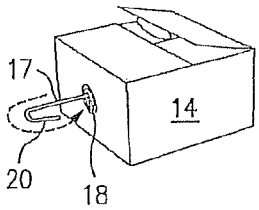

FIG. 3 illustrates the creation of a loop 20 with the inside end of the coiled material 10. The inside end 17 (not shown, see FIGS. 7 & 8) of the coiled material 10 is inserted back into a "trap door" (see FIGS. 7 & 8) in the plastic locking ring 18. This loop 20 makes the coiled material 10 easily available to the end user. When the loop 20 is pulled by a user of the wound filamentary material in container 14, the cover panel breaks away (see FIGS. 7 & 8). more detailed description of the structure of the loop 20 and the "trap door" is provided with the description of FIGS. 7 and 8.

Figure 4:
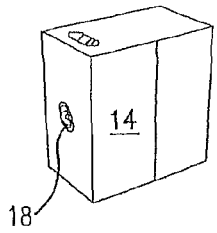
FIG. 4 illustrates a finished container or package with the looped end of the coiled material being conveniently recessed into the plastic locking ring, yet is readily available to the end user. This enables all of the panels of the container to be as flat as possible-allowing containers to be stacked with minimum negative space.

FIG. 4 illustrates a finished container or package 14 with the looped end of the coiled material being conveniently recessed into the plastic locking ring 18, yet is readily available to the end user. This enables all of the panels of the container 14 to be as flat as possible-allowing the containers to be stacked with minimum negative space.

Figure 5:
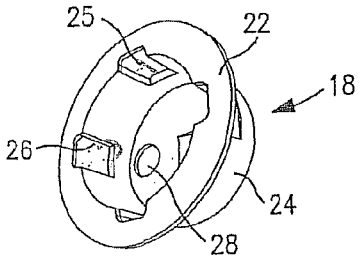
FIG. 5 is an isometric view of the plastic locking ring showing the circular flange around the cup and a hole in the circular flange through which the end of the filamentary material is passed.

In the isometric view of the plastic locking ring 18 shown in FIG. 5, circular flange 22 is formed around one end of the cup 24 and a hole 28 in the bottom cup 24 enables the end of the filamentary material (not shown) to pass through the hole 28. The cup 24 includes teeth 25, 26 formed around the circumference of the cup 24 (only two teeth of four are shown) by which the plastic ring 18 is attached to the hole 16 in the container 14 (FIG. 2).

Figure 6:
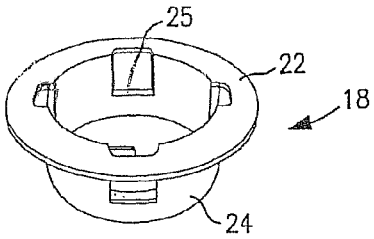
FIG. 6 is a detail view of the plastic locking ring showing the circular flange and the arrangement of the teeth around the circular flange of the cup.

FIG. 6 is a detail view of a portion of the plastic locking ring 18 showing the circular flange 22, the cup 24 and the arrangement of one of the teeth 25 around the circular flange 22.

Figure 7:
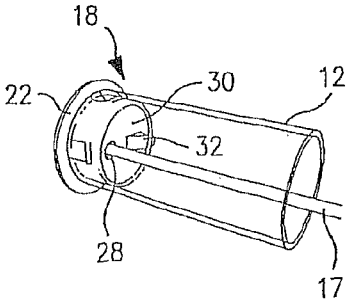
FIG. 7 is a detail view of the plastic locking ring and a portion of the paper payout tube with an end portion of the coiled material extending into the plastic locking ring.

FIG. 7 is a detail view of the plastic locking ring 18 coupled with a portion of the paper payout tube 12 with an end portion 17 of the coiled filamentary material extending into the hole 28 in the circular plate 30 of the plastic locking ring 18. A "trap door" 32 is formed in the circular plate 30 as is more fully described with respect to FIG. 8.

Figure 8:
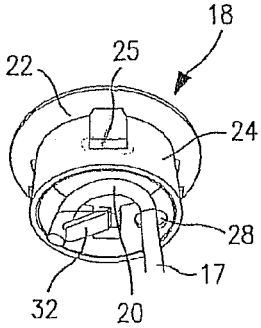
FIG. 8 is a detail view of the plastic locking ring showing the cup with the circular flange, the teeth (only one tooth is shown) around the periphery of the cup and the loop of the end of the coiled material formed within and outside the plastic locking ring through a hole and trap door in the circular flange of the plastic locking ring.

FIG. 8 is a detail view of the plastic locking ring 18 showing the cup 24 with circular flange 22 and one tooth 25 (of four) formed around the circumference of cup 24. The loop 20 of the end portion 17 of the coil is formed by passing the end portion 17 through hole 28 and into the "trap door" 32.

Figure 9:
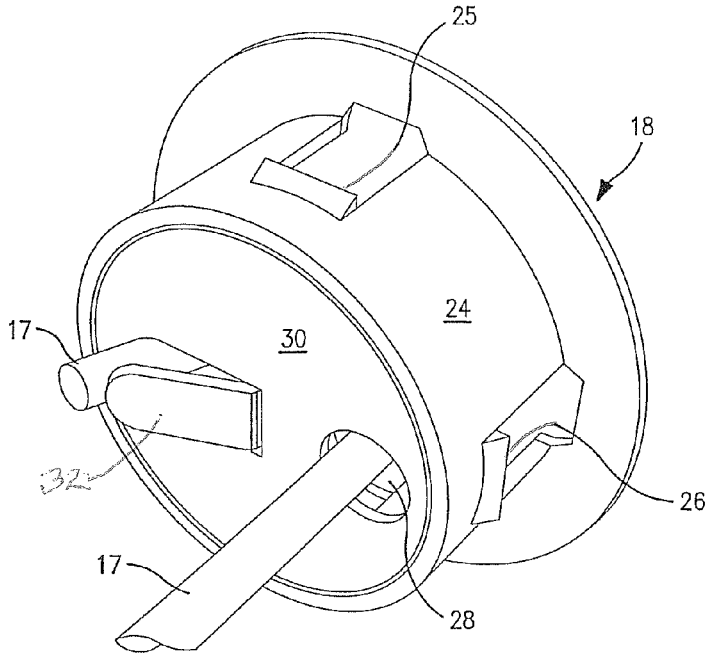
FIG. 9 is a detail view of the plastic locking ring showing two of the four locking teeth, a cover plate having an end portion of the wound material inserted through a hole in the cover plate and being retained in the cover plate by a "trap door" thereby forming a loop in the end portion of the wound material as shown more clearly in FIGS. 10 and 11.

FIG. 9 shows a view of the plastic locking ring 18 with two locking teeth (25, 26) of the four locking teeth on cup 24 and circular cover plate 30 having hole 28 for passage of the end portion 17 of the wound filamentary material to form a loop 20 (see FIG. 8) of the end portion 17 by retention of the end portion by a "trap door" in the cover plate 30.

Figure 10:
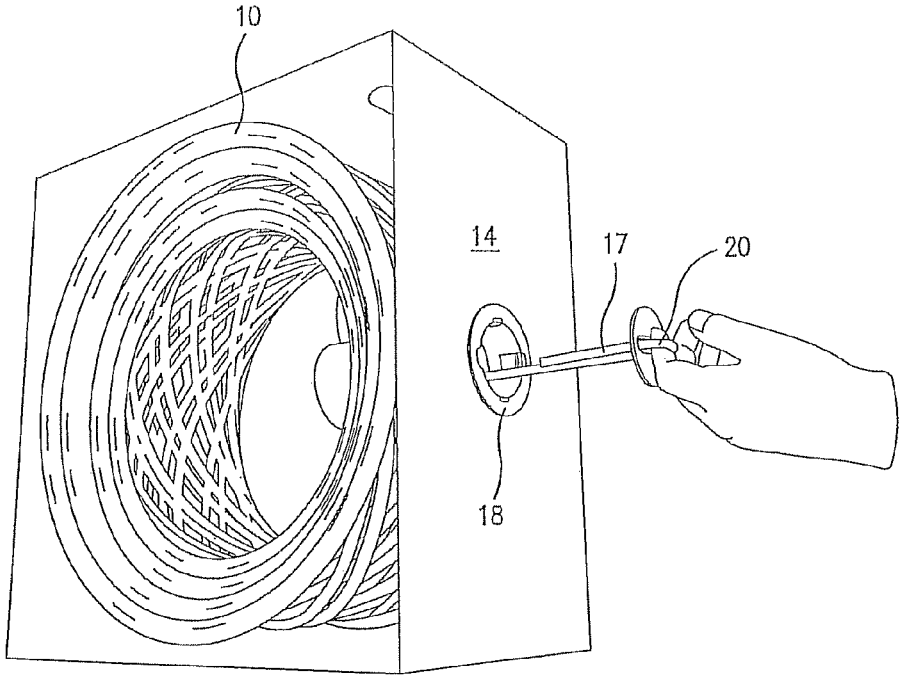
FIG. 10 is a partial cut away view of the container containing the wound filamentary material and showing the manner in which the end of the wound filamentary material is pulled from the container by a loop formed in the end of the wound filamentary material.

The partial cut-away view in FIG. 10 illustrates the manner in which the end portion 17 of the wound filamentary material 10 in the container 14 and the cover plate 20 are pulled from the plastic locking ring 18 by a loop 20 formed in the end portion of the wound filamentary material 10 and the cover plate 30.

Figure 11:
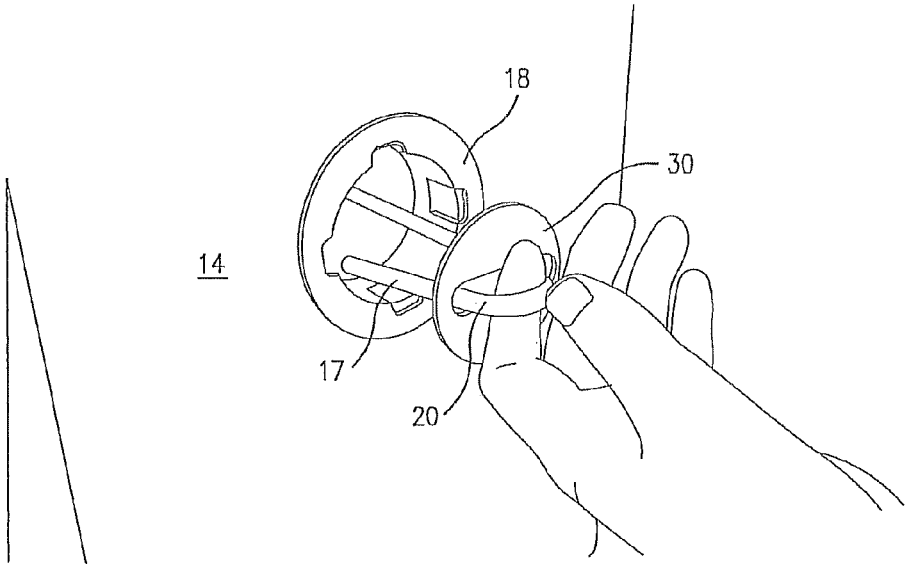
FIG. 11 is a detailed view of the manner in which the end of the wound filamentary material is pulled from the container by the loop formed in the end of the wound filamentary material.

FIG. 11 is a more detailed view of the plastic locking ring, the loop 20 formed in the end portion 17 of the wound filamentary material in the container 14 and the pulling of the end portion 17 of the wound filamentary material along with the cover plate 30. The loop 20 and the cover plate 30 provide a convenient and expeditious means of removing the wound material from the container of wound filamentary material.

The above description describes a package comprising a figure-eight coil of filamentary material, a container in which the coil of wound filamentary material is placed, a hollow, spiral-wound paper payout tube through which the filamentary material is dispensed, and a locking ring designed to secure the hollow payout tube to the container . The locking ring allows any readily available hollow paper payout tube of indeterminate length, but determinate diameter, to be utilized as figure-eight coil dispensing tubes in addition to providing a means for capturing the inside end of the wound coil with the purposes of preventing the filamentary material of the wound coil from falling back inside the container; making the end of the wound coil readily available for the end user, and preventing access and potential theft of the product.

The invention claimed is:

1. An apparatus for permitting removal of wound filamentary material (10) from a container (14) having a wall through a payout tube (12) through which a first end (17) of the filamentary material extends, the apparatus comprising:

a ring structure (24) having a side wall, a flange (22) extending from said side wall formed at a first end of said ring structure and having a larger diameter than said side wall of said ring structure, a pull-off cover plate (30)

formed with and breakably coupled at a second end of said ring structure, said cover plate defining a hole (28) receiving the first end of the filamentary material and a trap door (32) separate from said hole, said trap door receiving the first end (17) of the filamentary material and permitting the filamentary material extending therethrough to move through said trap door in a single direction only.

2. An apparatus according to claim 1, wherein:

said side wall of said ring structure has a plurality of teeth (25, 26) on an outside surface of said side wall of said ring structure.

3. An apparatus according to claim 2, wherein:

said plurality of teeth are radially located about said outside surface of said side wall and are adapted to engage an inner wall of the payout tube.

4. An assembly, comprising:

a) a wound coil of filamentary material having a first end formable into a loop;

b) a payout tube extending from an inside of said wound coil to an outside of said wound coil, said first end of said filamentary material extending through said payout tube;

c) a box containing said wound coil and payout tube, said box having a side wall defining a hole;

d) a ring structure having a side wall sized to fit in and through said hole of said box, a flange extending from said side wall formed at a first end of said ring structure and having a larger diameter than said side wall of said ring structure and located outside said box, a pull-off cover plate formed with and breakably coupled at a second end of said ring structure, said cover plate defining a hole receiving the first end of the filamentary material and said cover plate defining a trap door separate from said hole of said cover plate, said trap door receiving the first end of the filamentary material when said first end is formed in said loop and permitting the filamentary material extending therethrough to move through said trap door in a single direction only.

5. An assembly according to claim 4, wherein:

said side wall of said ring structure has a plurality of teeth on an outside surface of said side wall of said ring structure.

6. An assembly according to claim 5, wherein:

said plurality of teeth are radially located about said outside surface of said side wall.

7. An assembly according to claim 6, wherein:

said plurality of teeth engage said payout tube.

8. A method for packaging a wound coil of filamentary material for dispensing, comprising:

a) placing a payout tube into said wound coil of filamentary material and locating a first end of said filamentary material in said payout tube;

b) inserting said wound coil of filamentary material with said payout tube into a box;

c) pulling said first end of said filamentary material through a hole defined in a side wall of the box;

d) inserting a ring structure into said hole of said box, said ring structure having a side wall, a flange extending from said side wall formed at a first end of said ring structure and having a larger diameter than said side wall of said ring structure and located outside the box, and a pull-off cover plate formed with and breakably coupled at a second end of said ring structure, said cover plate defining a hole and a trap door separate from said hole of said cover plate;

e) locating said first end of said filamentary material through said hole defined in said cover plate and threading said filamentary material through said trap door to form a loop in said first end of said filamentary material.

9. A method according to claim 8, further comprising:

pulling on said loop to cause said pull-off cover to break from said ring structure and so said pull-off cover is pulled beyond said flange.

10. A method according to claim 8, wherein:

said inserting said ring structure into said hole of said box further comprises causing said ring structure to engage said payout tube.

11. A method according to claim 8, wherein:

said side wall of said ring structure has a plurality of teeth on an outside surface of said side wall of said ring structure.

* * * * *